US006301937B1

(12) United States Patent
Tatzel et al.

(10) Patent No.: US 6,301,937 B1
(45) Date of Patent: Oct. 16, 2001

(54) APPARATUS AND METHOD FOR DEKNITTING YARNS

(75) Inventors: Michael Tatzel, Fall River; Vasco R. Pacheco, Swansea, both of MA (US)

(73) Assignee: Globe Manufacturing Corporation, Fall River, MA (US)

( * ) Notice: Subject to any disclaimer, the term of this patent is extended or adjusted under 35 U.S.C. 154(b) by 0 days.

(21) Appl. No.: 09/203,558

(22) Filed: Dec. 2, 1998

(51) Int. Cl.[7] ..... D04B 19/00
(52) U.S. Cl. ..... 66/1 R; 28/218
(58) Field of Search ..... 66/1 R, 125 R, 66/125 A, 203, 213; 28/218, 170, 171

(56) References Cited

U.S. PATENT DOCUMENTS

| | | | | |
|---|---|---|---|---|
| 2,795,031 | * | 6/1957 | Gierling et al. | 66/1 R |
| 2,920,772 | | 1/1960 | Wilhelm et al. . | |
| 3,466,718 | * | 9/1969 | Adamson | 28/218 |
| 3,579,765 | * | 5/1971 | Eshuis | 28/218 |
| 3,646,646 | * | 3/1972 | Koizumi et al. | 28/218 |
| 3,720,984 | * | 3/1973 | Roberson et al. | 28/218 |
| 3,919,749 | * | 11/1975 | McWriter et al. | 66/1 R |
| 4,091,512 | * | 5/1978 | Chambley et al. | 28/218 |
| 4,185,364 | * | 1/1980 | Luckenbach | 28/218 |
| 4,545,099 | * | 10/1985 | Tovenrath et al. | 28/202 |
| 4,640,085 | | 2/1987 | Rupprecht . | |
| 4,870,839 | * | 10/1989 | Odham | 66/125 R |
| 5,113,564 | * | 5/1992 | Suzuki | 28/218 |
| 5,611,949 | * | 3/1997 | Snellman et al. | 219/121.67 |

FOREIGN PATENT DOCUMENTS 1 510 712 4/1968 (FR) .

* cited by examiner

*Primary Examiner*—Danny Worrell
(74) *Attorney, Agent, or Firm*—Pillsbury Winthrop LLP

(57) ABSTRACT

An apparatus and method for deknitting a knitted tape of yarn having a plurality of yarn ends. The apparatus includes a plurality of stationary cylindrical connectors arranged in parallel alignment across the frame structure of the apparatus. One stationary connector, proximate to the knitted yarn receiving end of the apparatus, is positioned parallel to and beside an adjustable cylindrical connector which can be selectively moved closer to or further away from the stationary connector. The adjustable and parallel stationary connector thus form a deknitting restraining gap of adjustable dimension, the dimension being adjustable to restrict the traverse of the knitted yarn sufficiently to effectively deknit the yarn with uniform tension on each yarn end being deknitted. The apparatus uniformly deknits yarns of various types and deniers.

25 Claims, 6 Drawing Sheets

APPARATUS AND METHOD FOR DEKNITTING YARNS

BACKGROUND OF THE INVENTION

1. Field of the Invention

The present invention relates to a textile machine which can be used for deknitting yarns, in particular a machine which can be used to deknit elastomeric yarns from a knitted tape of elastomeric yarns in such a manner as to uniformly apply tension on each end being deknitted.

2. Background of the Invention

In the field of textile manufacturing and in particular in the practice of spandex yarn production, it has become a common practice to knit a tape of elastomeric yarns. This practice has proven advantageous in that it provides manufacturers with a method of delivering multiple ends of the elastomeric yarns in a convenient way to narrow fabric manufacturers without having to resort to the installation of creels and individual tensioning/controlling devices for each yarn end. The practice results in significant savings to the manufacturers in space and creeling preparation time.

It is common in the preparation of a tape of elastomeric yarns to employ textile machines for making narrow elastic fabric receive and knit together a plurality of elastic and conventional yarn ends from a number of incidental yarn packages mounted on large creel frames adjacent to the machine. This practice of knitting a plurality of elastic yarn ends into a compact knitted yarn package or tape which must subsequently be deknitted during the feeding operation has proven effective to reduce the floor space required for the yarn supply arrangement and, in addition, to improve the efficiency and ease of transporting the yarn. Examples of such yarn packages are disclosed in U.S. Pat. Nos. 3,827,261, 4,411,142 and 5,569,212. These methods of handling yarn have proven especially useful for elastic yarn, such as spandex, which may shrink, take a permanent set, or distort the yarn package during storage when handled conventionally, thereby presenting problems of non-uniform tension, snarling, and the like when the yarn is fed to the textile fabric making machine.

Attempts to use knitted yarn packages of highly elastic yarns of relatively high denier has resulted in numerous problems. Early efforts required undesirably low feeding speeds which resulted in significant economic losses over a period of time in view of the capital investment in modern, high-speed, textile fabric forming machines since the slow speed of deknitting did not permit the operator to take full advantage of the production capacity of the high speed machines.

U.S. Pat. No. 3,542,084 provided a device for feeding and unraveling a knitted yarn package. In that device, a separate advancing mechanism passes the strip from the knitted yarn package through a pair of feed rolls. The motor driving the rolls is controlled by a relay activated by an electrically conductive finger which rests above the advancing yarn strip and a grounded bracket below the yarn strip. When the yarn unravels past the point where it is no longer between the finger and the bracket, the relay is activated, thereby causing the motor to turn the feed rolls.

Such a device has proven to have certain disadvantages. First, if used with a yarn package having a plurality of ends, a single, incompletely unraveled yarn end could prevent the finger from contacting the bracket, thereby preventing the feed rolls from advancing the knitted yarn package. Second, no means are provided for controlling the tension as the strip is advanced. Third, no means are provided for adding tension over the amount necessary to cause the knitted yarn package to unravel. Finally, the design, as shown in FIG. 3 of the '084 patent, is not easily adaptable for feeding a modern textile fabric forming machine which is capable of using a plurality of knitted yarn packages and, consequently, would require a number of feeders for each textile machine.

Another well-known apparatus which has previously been adapted for feeding knitted yarn packages is illustrated in U.S. Pat. No. 2,920,772. This apparatus commonly referred to as a "mousetrap" includes a plurality of parallel pins aligned perpendicular to the direction of movement of the knitted yarn package as it moves towards the textile fabric making machine. The pins are mounted alternatively to an upper, pivoting member and a lower stationary base member. The knitted yarn package is then passed between the plurality of pins. Tension is added by adding weight to the upper pivoting member to cause the pins mounted thereto to press against the moving knitted yarn package, thereby increasing the resistance to movement of the knitted yarn package.

Another device which is similar to the "mousetrap" device is commonly referred to as a "ladder". This device also includes a plurality of parallel pins; however, unlike the "mousetrap" device, the pins are arranged similarly to rungs on a ladder. The knitted yarn package is then threaded over and under as many rungs as needed to provide sufficient tension to unravel the knitted yarn package.

Certain disadvantages are also apparent with both of these designs. First, no means are provided for ensuring uniform tension across the width of the knitted yarn package resulting in one or more yarn ends being under more or less tension than the other. Thus, the amount of these latitudinal tension variations may cause the fabric produced by, for example, a knitting machine, to skew since the amount of tension through one portion of the fabric may differ from the remainder of the fabric. Second, no means are provided for controlling the tension in the direction of movement of the knitted yarn package after the tension initially has been set. Thus minor changes in the textile fabric making machine's feed speed may result in differences in the amount of this longitudinal tension that may cause the pick count of the finished fabric to fall outside of prescribed limits. Furthermore, larger changes in the feed speed may result in breakout (i.e., the amount of tension exceeds the breaking strength of the yarn end) or "blow-up" (i.e., the amount of tension is less than the force needed to unravel the knitted yarn package and some incompletely unraveled yarn ends actually enter the fabric, making machine). A common problem associated with the use of the standard ladder device in deknitting operations is the constant surging of the tape being fed into the device.

U.S. Pat. No. 4,870,839 is a deknitting device similar to the "mousetrap" and "ladder" devices but employing a support member upstream of the textile fabric making machine and generally perpendicular to the direction of movement of the yarn ends towards the machine. The support member of '839 patent engages the yarn ends prior to the yarn ends being absorbed by the device in an effort to enhance unraveling the knitted yarn package. Th'839 deknitting device further relies on the unraveling function of a plurality of bristles mounted on a rotating cylinder, the rotation of which is coordinated with the speed of the receiving textile machine by a belt drive. This complicated device, like the conventional deknitting devices described above, fails to solve the critical problems of uneven tension on the tape being deknitted and the related problem of surging of the tape due to high and uneven tension.

It is therefore desirable to develop an apparatus for feeding a knitted yarn package having a plurality of yarn ends to a textile machine for knitting narrow elastic fabric that will uniformly unravel the knitted yarn package. In addition is has become desirable to develop an apparatus for feeding a knitted yarn package that will apply substantially uniform and constant tension to the yarn ends being fed to the machine even if the speed of the machine changes, thus overcoming the aforementioned problems associated with conventional deknitting devices. Finally it has become desirable to develop such an apparatus which is simple to install, use and maintain.

For the above reasons, the requirement for an effective deknitting device is of paramount importance. Critical to the effectiveness of a deknitting device is the uniform deknitting of the tape and the application of uniform tension on each yarn end being deknitted.

SUMMARY OF THE INVENTION

The present invention solves the aforementioned problems associated with conventional devices used for deknitting yarns made of elastomeric materials. An example of such elastomeric materials is the commercial product spandex.

It is an object of the present invention to provide an elastic yarn deknitting device which uniformly deknits tapes of yarns while applying uniform tension on each individual yarn being deknitted.

It is also an object of the present invention to provide an elastic yarn deknitting device which overcomes the problem of surging of the yarn being deknitted.

It is also an object of the present invention to provide an elastic yarn deknitting device which is adjustable to permit deknitting of tapes of yarn of a wide variety of deniers.

DETAILED DESCRIPTION OF THE INVENTION

Figure 1:
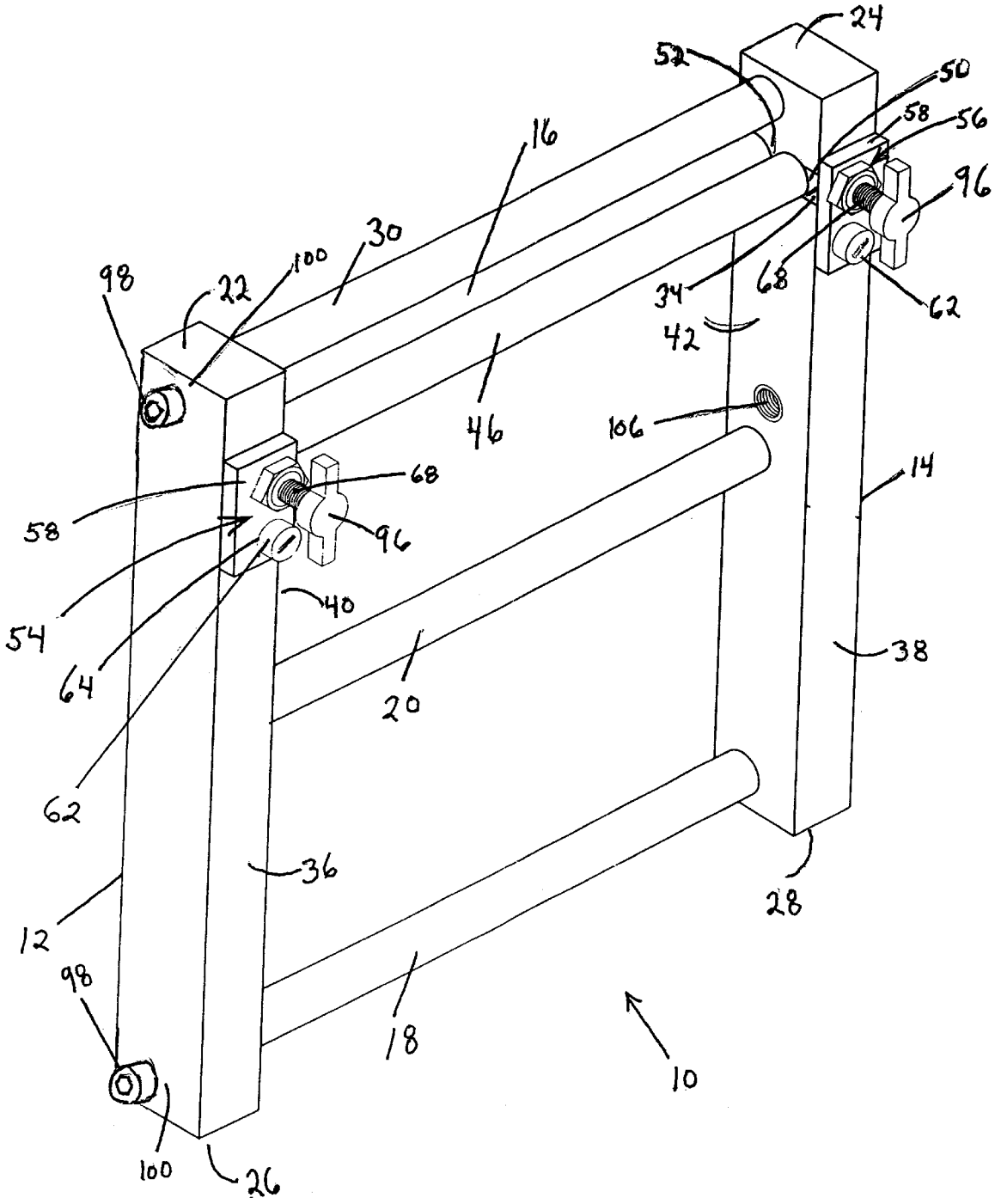
FIG. 1 is a perspective view of a deknitting device embodying the principles of the present invention.

Referring to FIGS. 1–4, there is shown therein a deknitting device, generally indicated at 10, embodying the principles of the present invention. The deknitting device 10, includes two transversely spaced frame members 12, 14 which are oriented one to the other in a generally parallel fashion. The two frame members 12, 14 are connected one to the other by a plurality of generally cylindrical transverse stationary connectors 16, 18, 20. The plurality of stationary connectors 16, 18, 20 are secured in a generally perpendicular fashion to the opposing surfaces of the frame members 12, 14 and are oriented one stationary connector to another in a generally parallel fashion. The stationary connectors 16, 18, 20 are spaced along the length of the frame members 12, 14 such that at least one stationary connector 16 is located proximate to respective first ends 22, 24 of each of the frame members 12, 14 and at least one stationary connector 18 is located proximate to respective second ends 26, 28 of the frame members 12, 14.

A tape guiding connector 30, of similar size and configuration to the stationary connectors 16, 18, 20 can be secured in a generally perpendicular fashion to the opposing surfaces of the frame members 12, 14. The tape guiding connector 30 is positioned distal to and generally parallel to the stationary connector 16.

First and second receiving slots 32, 34 are defined in each of the frame members 12, 14, respectively, at a position approximately beside the connecting points of the stationary connector 16. Each of the first and second receiving slots 32, 34, from the perspective of the frontal surfaces 36, 38 of frame members 12, 14, is defined as an open-sided closed terminus bore hole. The open sides of receiving slots 32, 34 directly oppose one another on the opposing surfaces 40, 42 of the frame members 12, 14. The receiving slots 32, 34 are configured as mirror images of each other and, when viewed from the opposing sides 40, 42 of the frame members 12, 14, each is defined as an open-sided elongated slot having a terminus which is rounded from top to bottom (best seen in FIGS. 3 and 4 at 44), the top of the terminus 44 being proximal to the first end of frame member 12 or 14. The receiving slots 32, 34 have a diameter slightly larger than the cross-sectional diameter of the stationary connectors 16, 18, 20.

A generally cylindrical transverse adjustable connector 46, having a cross-sectional diameter similar to the diameter of the stationary connectors 16, 18, 20, and slightly smaller than the diameter of the receiving slots 32, 34, is sized so as to have a first end 48 adjustably positioned in the first receiving slot 32 and a second end 50 adjustably positioned in the second receiving slot 34. When so positioned, the adjustable connector 46 is adjustably connected in a perpendicular orientation to frame members 12, 14 and is in a generally parallel orientation to and directly beside stationary connector 16. Because the diameter of the adjustable connector is slightly smaller than the diameter of receiving slots 32, 34, the adjustable connector is capable of lateral movement in the receiving slots 32, 34. Such lateral movement permits the adjustable connector 16 to be adjustably positioned in the receiving slots 32, 34 either closer to or further away from the stationary connector 16. A deknitting restraining gap 52 is defined by the rectangularly shaped area defined by the parallel oriented stationary connector 16 and adjustable connector 46 and the frame members 12, 14.

An adjusting assembly, generally shown at 54, 56, is connected to each of frame members 12, 14, respectively, at a position on the frontal surfaces 36, 38 which is adjacent to each of the receiving slots 32, 34. Further description of both adjusting assemblies 54, 56, will be represented in the following detailed description of one adjusting assembly 54, shown best in FIGS. 1, 3 and 4. The adjusting assembly 54 includes a generally planar retaining member 58 which includes a through-bore 60. The retaining member 58 can be removably attached to the frontal surface 36 of frame member 12. A securing member 62 can be threadably engaged through a securing port 64 defined in the planar surface of the retaining member 58. The securing member 62, after passing through the securing port 64, can be threadably engaged with a threaded blind hole 66 defined in the frontal surface 36 of frame member 12 and thus serve to engage the retaining member 58 flat against the frontal surface 36 of frame member 12. When so engaged with the frame member 12, the retaining member 58 provides a stop to effectively retain the first end 48 and second end 50 of the adjustable connector 46 in the receiving slot 32 of frame member 12. The through-bore 60 aligns with the longitudinal axis of the underlying receiving slot 32. The through-bore 60 is of a smaller diameter than the diameter of the receiving slot 32 and serves to adjustably retain an adjustment controller 68. The adjustment controller 68 can be threadably engaged with the through-bore 60. A tension member 70 is sized and configured to be positioned within the receiving slot 32 between and in contact with the terminus 44 of receiving slot 32 and the lateral surface of the first end 48 of adjustable connector 46. The tension member 70 when so positioned biases the adjustable connector 46 laterally in the receiving slot 32 and outwardly away from stationary connector 16. The elongated configuration of receiving slot 32 maintains the adjustable connector 46 in a parallel position with stationary connector 16, but does permit the deknitting restraining gap 52 to be widened as the adjustable connector 46 is forced away from the stationary connector 16. The adjustment controller 68, being adjustably retained by the retaining member 58 is capable of being adjusted inwardly through the through-bore 60 and the longitudinally aligned receiving slot 32 until the adjustment controller 68 contacts the first end 48 of the adjustable connector 46. Further inward adjustment of the adjustment controller 68 serves to force the adjustable connector against the outwardly directed bias of the tension member 70. Coordinated inward adjustment of the adjustment controller 68 on each of the frame members 12, 14 moves the adjustable connector 68 toward the stationary connector 16 to effectively narrow the deknitting restraining gap 52. The adjustment controller 68 can be adjusted to effect inward or outward movement of the adjustable connector in fine increments of about ±0.005 inches. Spacing between the adjustable connector 46 and the parallel stationary connector 16 can be adjusted as necessary to form the deknitting restraining gap 52 appropriate to effectively deknit a wide variety of types and deniers of yarns. Spacing in the deknitting restraining gap of about 0.05 to about 0.090 inches and more preferably about 0.065 to about 0.080 inches is desirable to effectively deknit tapes of elastic yarns such as spandex. A locking piece 71 can be provided to secure the adjustment controller 68 in the selected position. Although it will generally be preferred to maintain the adjustable connector 46 and the stationary connector 16 in a generally parallel alignment to each other, the adjustment controllers 68 on frame members 12, 14 can be independently adjusted such that the adjustable connector 46 is not in parallel alignment with the stationary connector 16.

In addition to the advantage of the adjustable dimension of the deknitting restraining gap 52 of the present invention, a critical aspect of the apparatus is the use of a rotatable sleeve 72 covering at least a portion of one or more of the tape guiding connector 30, the stationary connectors 16, 18, 20 and the adjustable connector 46. The rotatable sleeve 72 is sized and configured to cover the exposed portions of each of the above listed different types of connectors 16, 18, 29, 30, 46 while still being able to freely rotate about the connector. The rotatable sleeve 72 can be formed of any smooth material to include, for example, plastic, metal, glass and like materials. Preferably the rotatable sleeve is formed of plastic material. The rotatable sleeve to be most effective will have a low coefficient of friction on both the inside and outside surfaces of its cylindrical form. A rotatable sleeve of seamless construction is preferred. The sleeve can rotate directly on the connectors or can be rotatably mounted to the connectors via bearings or bushings. The sleeve can be coated for ease of rotation about the respective connectors with any material which serves to reduce the coefficient of friction of the contact surface.

In operation, the adjustment controller 68 for each of the adjusting assemblies 54, 56 is adjusted to form a spacing in the deknitting restraining gap 52 appropriate for the type of yarn and denier being deknitted. A tape of yarn is fed into the deknitting device 10, being directed by the tape guiding connector 30 through the deknitting restraining gap 52 formed between the adjustable connector 46 and the parallel stationary connector 16. Under uniform tension and with appropriate adjustment of the spacing of the deknitting restraining gap, the tape of yarn is deknitted in the deknitting zone 74 defined between the sleeve-covered tape guiding connector 30 and the side by side oriented sleeve-covered stationary connector 16 and the sleeve-covered adjustable connector 46. Continued passage under uniform tension of the deknitted yarns through the deknitting device 10 is facilitated by the passage of the yarns over the sleeve-covered stationary connectors 18, 20. The tape of yarn is effectively deknitted without the uneven tension and tape surging problems previously associated with conventional deknitting devices.

Figure 5:
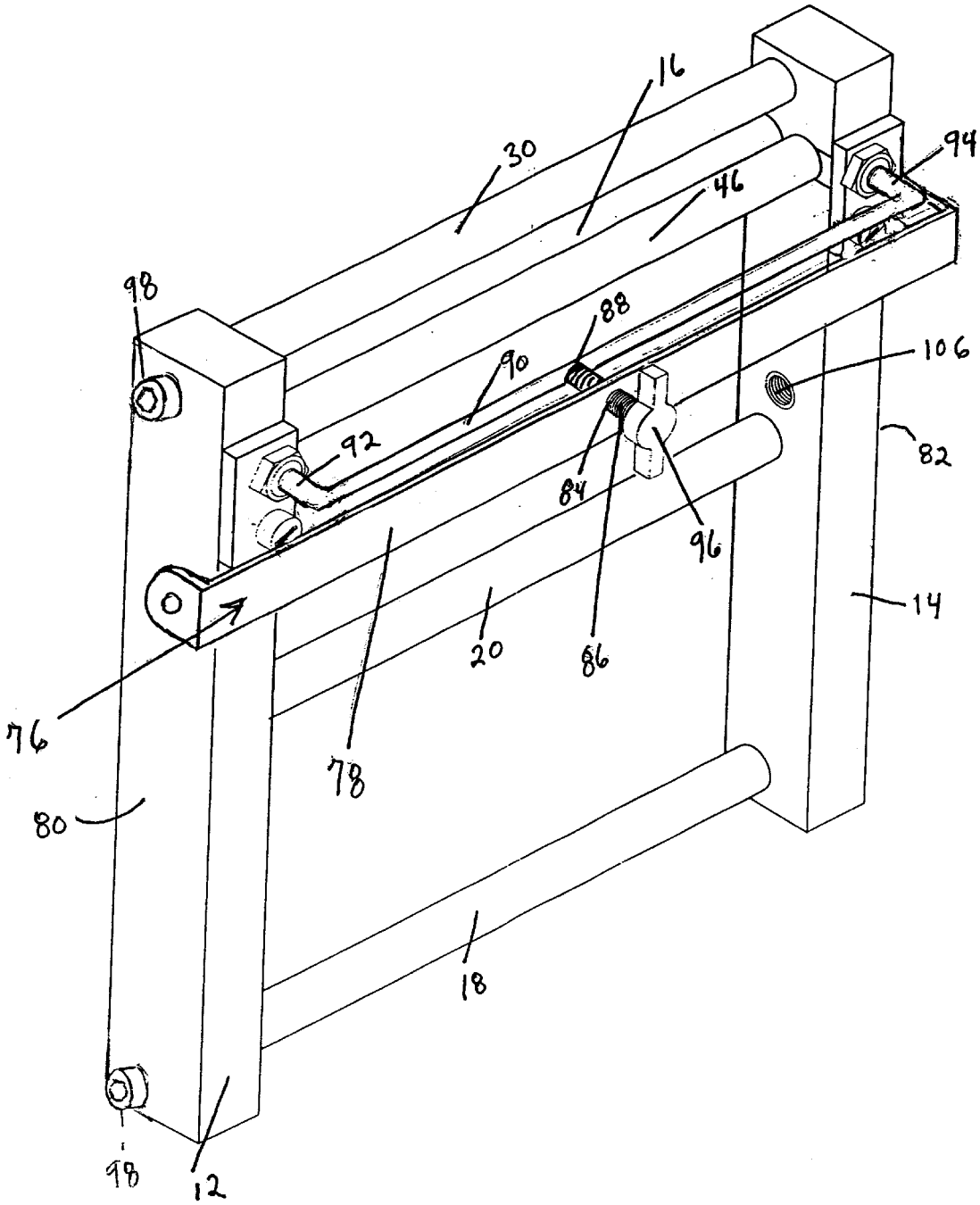
FIG. 5 is a perspective view of an adjustment coordinating assembly of an alternative embodiment of the deknitting device embodying the principles of the present invention.

As best shown in FIG. 5, in a second embodiment of the present invention the incremental adjustment of the adjustment controller 68 for each of the adjustment assemblies 54,56 located on frame members 12, 14 can be synchronized by operation of an adjustment coordinating assembly 76 to effect a simultaneous, identical degree of inward or outward adjustment of the first end 48 and second end 50 of the adjustable connector 46 in the first receiving slot 32 and second receiving slot 34 of respective frame members 12, 14.

The adjustment coordinating assembly 76 includes a coordinating assembly frame structure 78 which is connected in alignment with the adjusting assemblies 54, 56 on the outboard surfaces 80, 82 of frame members 12, 14. When so connected, the coordinating assembly frame structure 78 directly overlies the adjusting assemblies 54, 56 and spans the separation between frame members 12, 14. The coordinating assembly frame structure 78 defines a threaded bore 84 located approximately midway between the frame structures 12, 14. A coordinating adjustment control 86 is threadably engaged through the threaded bore 84 and at its control rotation point 88 is rotatably connected to an elongated coordination actuator 90 which underlies in a parallel orientation the coordinating assembly frame structure 78. The two ends of the elongated coordination actuator 90 are positioned directly over the respective through-bores 60 of each of the actuating assemblies 54, 56. Directly over the respective through-bores 60, each end of the elongated coordination actuator 90 turns at an approximately right angle to form a first and a second actuator arm 92, 94. For example, in this alternative embodiment, the first actuator arms 92 replaces the adjustment control 68 in the above description of the adjusting assembly 54 and is sized and configured to be able to easily pass through a smooth surfaced through-bore 60 of the actuating assembly 54. In this embodiment, the modification of the actuating assemblies 54, 56 is identical.

Figure 6:
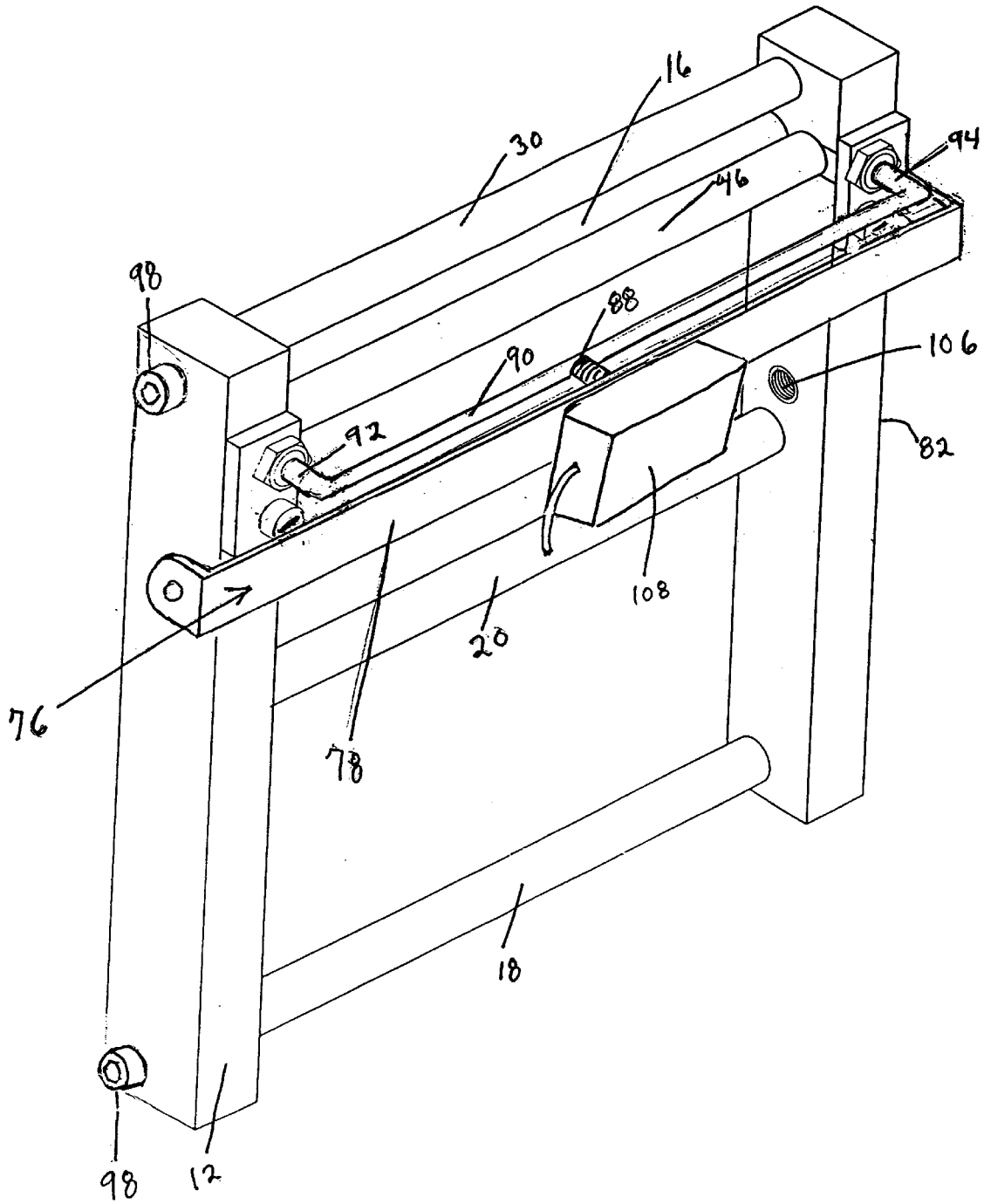
FIG. 6 is a perspective view of an automated motorized adjustment coordinating assembly of an alternative embodiment of the deknitting device embodying the principles of the present invention.

In operation of this alternative embodiment, the operator selectively rotates the coordinating adjustment control 86 to move the coordinating adjustment control inwardly or outwardly in relation to the coordinating assembly frame structure 78 with which it is threadably engaged through the threaded bore 84. An inward movement of the rotating coordinating adjustment control 86, because of its rotatable connection to the coordination actuator 90, will cause the coordination actuator 90 to move closer to the frontal surfaces 36, 38 of the frame members 12, 14. Because the actuator arms 92, 94 are slidably positioned within the respective through-bore 60 of each of the actuating assemblies 54, 56, when the coordinating actuator 90 is adjusted to move closer to the frontal surfaces 36, 38, the actuator arms 92, 94 move deeper into the respective receiving slots creating a coordinated force against the first end and second end 48, 50 of the outwardly biased adjustable connector 46. This coordinated force results in a coordinated adjustment of the adjustable connector 46 to a position closer to the parallel oriented stationary connector 16. The examples of the different embodiments of the present invention described herein are presented with a manual controller 96 for hand adjustment of the adjusting assembly. However, adjustment of the adjusting assembly can instead be carried out by motorized operation (as best shown in FIG. 6) to include the use of an automated adjuster 108. Further, the automated adjuster can be computer controlled without departing from the scope of the present invention.

The present invention can be provided with a method of disassembly to facilitate repair and replacement of components such as, for example rotatable sleeves that may become worn or in some other way in need of replacement. For example, as best shown in FIG. 1, the tape guide connector 30 and/or one or more of the stationary connectors 16, 18, 20 can be removably connected to the frame members 12, 14. When in an assembled and operationally ready configuration the removably connected tape guide connector 30 and stationary connectors 16, 18, 20 can be held securely to the frame members 12, 14 by use of assembly locks 98 which in the example described herein would be threadably secured to the ends of connectors which pass to the outboard surfaces 80, 82 of the frame members 12, 14 through locking passages 100 defined in the frame members 12, 14. Preferably a socket headcap screw is provided as the assembly lock 98. However, any other method of selectively securing the assembled device in an operational configuration may be used without departing from the scope of the present invention. Other methods of securing the assembled device may include, for example, the use of cotter pins, grooved connectors with interacting locking washers, lock nuts and the like.

Figure 2:
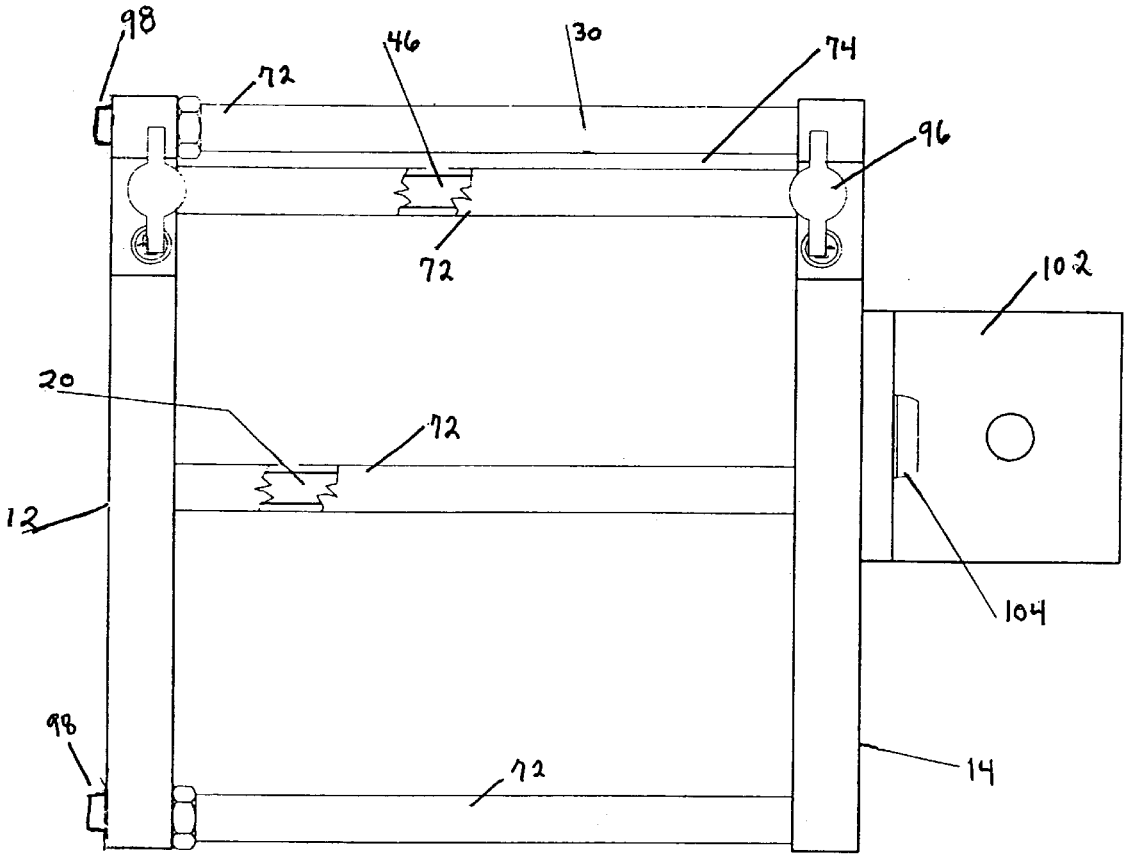
FIG. 2 is front elevational view of a deknitting device embodying the principles of the present invention.
Figure 3:
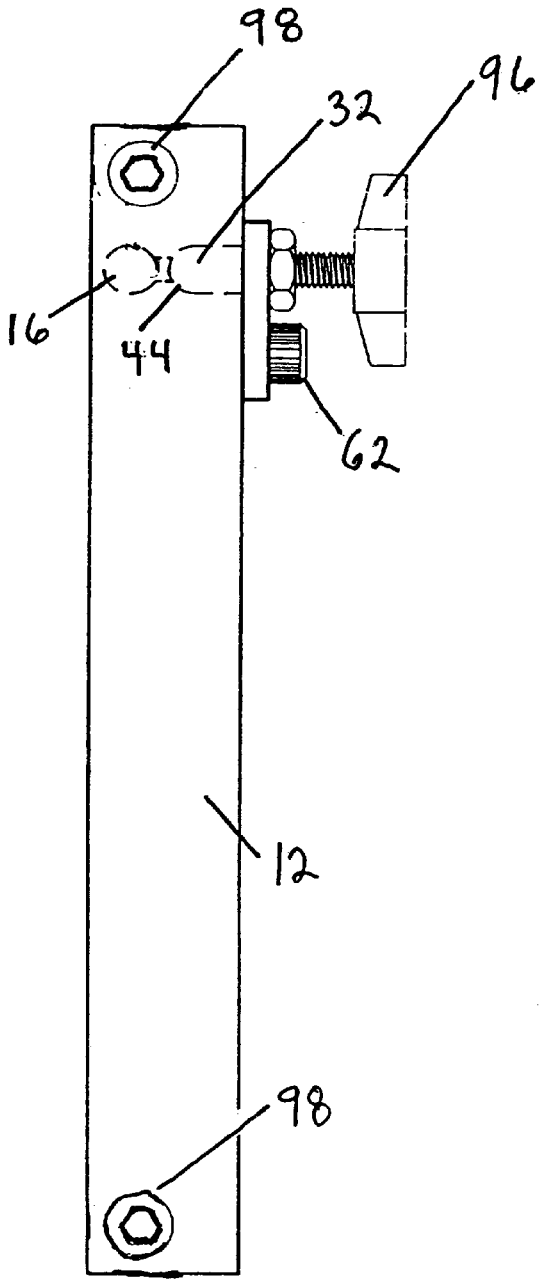
FIG. 3 is a side elevational view of a deknitting device embodying the principles of the present invention.
Figure 4:
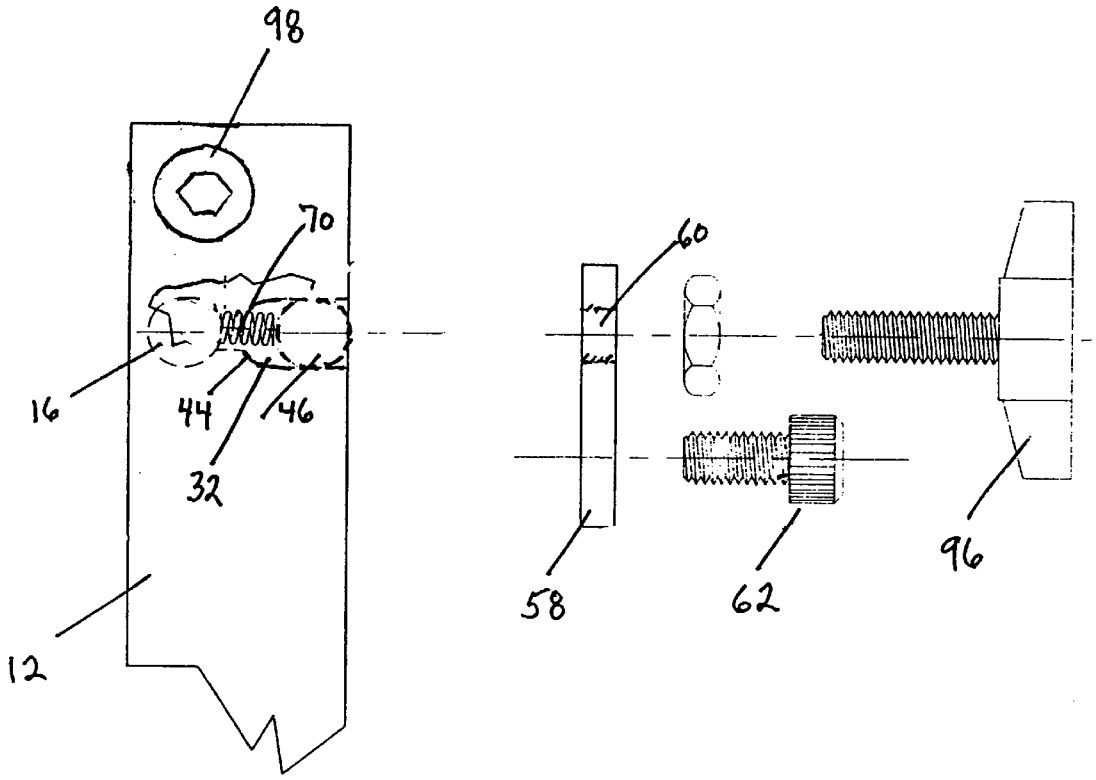
FIG. 4 is an enlarged exploded view of the tension adjustment mechanism of a deknitting device embodying the principles of the present invention.

When in operation the deknitting device 10 is normally associated with a textile making machine and to facilitate feeding the deknitted yarns into the textile making machine, would be mounted on the textile making machine near the entry point for the yarns. As best seen in FIG. 2, a mounting member 102 can be connected to at least one of the frame members of the deknitting device 10. In the example described herein, the frame member is removably mounted to the frame member 14 by passage of a mounting member lock 104 which is threadably engaged with a mounting member locking bore 106 (best seen in FIG. 1). It is, however, within the scope of the invention to removably secure the mounting member using other known locking devices such as, for example, cotter pins, grooved connectors with interacting locking washers, lock nuts and the like. It is also within the scope of the invention to fixedly connect the mounting member 102 to the frame member using known securing methods such as, for example, casting, welding, riveting, gluing and the like.

The present invention provides an apparatus and method for use whereby tapes of yarns of a wide variety of types and deniers can be effectively deknitted while applying uniform tension on each individual yarn end being deknitted. Different types and deniers of knitted yarn were deknitted using the apparatus and method of the present invention to demonstrate the versatility and effectiveness of the present invention. Adjustment of the spacing for each of the test runs reflects the distance between the adjustable connector 46 and the parallel stationary connector 16. The types and deniers of yarns and the results of the test runs are recorded in Table 1.

The present invention has been described above with exemplary preferred embodiments. However, it is to be understood that the scope of the present invention need not be limited to the disclosed preferred embodiments. On the contrary, it is intended to cover various modifications and similar arrangements within the scope defined in the following appended claims. The scope of the claims should be accorded the broadest interpretation so as to encompass all such modifications and similar arrangements.

TABLE 1

COMPARATIVE DEKNITTING TEST RBSULTS FOR DIFFERENT TYPES/DENIERS OF KNIT TAPE

| Denier | Type | # of End/Tape | # of Ends Gram Tension* | | Device New | Device Standard | Spacing | Observations |
|---|---|---|---|---|---|---|---|---|
| 1680 | S-30 Clear[1] | 60 | 6E[2] | 70–85[3] | ✓ | | .075"–.080 | L-311 FX Return Material[4] Badly yellowed, old |
| 840 | S-30 Clear | 60 | 6E | 35–50 | ✓ | | .070" | L-341 FX Yellow material tight release |
| 840 | S-30 Clear | 42 | 6E | 35–45 | ✓ | | .070" | L-341 FX Smaller loops & tighter release reduced gram variation |
| 1400 | S-30 Clear | 60 | 6E | 55–80 | ✓ | | .065"–070" | L-315 FX |
| 1120 | T-141 White | 28 | 6E | 40–50 | ✓ | | .065" | Soft hand feel |
| 1240 d'tex[6] | T-136 Clear Lycra | 16 | 6E | 50–60 | ✓ | | .065" | Soft hand feel |
| 1120 | S-30 Clear | 40 | 6E | 80–100 | ✓ | | .070" | L-396 FX |
| 840 | S-30 Clear | 40 | 6E | 35–50 | ✓ | | .070" | L-340 FX Demonstration Sample |
| 840[7] | S-5 Clear[8] | 60[9] | 6E | 90[9] | ✓ | | .070"[10] | L-152[4] |
| | | | | 80–100 | | ✓ | | |
| 2240[7] | S-7 White[11] | 48[9] | 3E[2] | 150–165[9] | ✓ | | .075"[10] | Return material[5] |
| | | | | 170–210 | | ✓ | | |

TABLE 1-continued

COMPARATIVE DEKNITTING TEST RBSULTS FOR DIFFERENT TYPES/DENIERS OF KNIT TAPE

| Denier | Type | # of End/Tape | # of Ends Gram Tension* | | Device New | Device Standard | Spacing | Observations |
|---|---|---|---|---|---|---|---|---|
| 5040[8] | S-5 Clear[8] | 40[9] | 2E[2] | 150–160[10] | ✓ | | .085"[10] | returns badly yellowed - tight[5] |
| | | | | 220–250 | | ✓ | | |
| 840 | S-30 Clear | 14 | 6E | 35–50 | ✓ | | .045"[10] | Special lube (2-25-98)[12] |

Note: All samples listed above deknitted well
*Gram tension - measurement made with Schmidt Tensiometer (20–300).
[1]S-30 clear (spandex thread-polyether
[2]6E - six end of thread etc.
[3]70–85 grams tension-measured
[4]L-311FX lot-311 Fall River, experimental
[5]Return material
[6]d'tex - decitex - one tenth of a tex tex - a unit for expressing linear density, equal to the weight in grams of 1 kilometer of yarn, filament, fiber, or other textile strand. The system of yart numbering based on the use of tex units.
[7]840, 1120, 2240, 5400 - denier
[8]S-5 clear - polyester spandex thread - clear color
[9]60, 48, 40 etc. - number spandex ends
[10].070, .075, .080 etc. - measurement in thousands of an inch
[11]S-7 white - polyester spandex thread - white color
[12]Special lube - experimental lubrication

What is claimed is:

1. An apparatus for deknitting a tape of yarn under substantially uniform and constant tension comprising:

(a) a frame structure having at least two frame members, said frame members each having a first end and a second end, said frame members supporting at least one stationary connector between said frame members;

(b) an adjustable connector, adjustably supported between said frame members;

(c) an adjustment controller movably connected to said frame structure and in contact with said adjustable connector, wherein said adjustment controller when selectively moved serves to adjust the proximity of said adjustable connector to said stationary connector to define a deknitting restraining gap for receiving a tape of yarn between said stationary connector and said adjustable connector, wherein said tape of yarn when fed through said deknitting restraining gap is substantially uniformly deknitted under constant tension.

2. An apparatus for deknitting a tape of yarn according to claim 1, wherein said adjustable connector is generally in parallel alignment with said stationary connector.

3. An apparatus for deknitting a tape of yarn according to claim 1, wherein at least one of said at least one stationary connector and said adjustable connector is of a generally cylindrical shape and is at least partially surrounded by a rotatable sleeve.

4. An apparatus for deknitting a tape of yarn according to claim 1, wherein all of said at least one stationary connector and said adjustable connector is of a generally cylindrical shape and is at least partially surrounded by a rotatable sleeve.

5. An apparatus for deknitting a tape of yarn according to claim 3, wherein said rotatable sleeve is of seamless construction and has an internal and external surface with a low coefficient of friction.

6. An apparatus for deknitting a tape of yarn according to claim 3, wherein said rotatable sleeve may be formed of a material selected from the group consisting of metal, glass and plastic.

7. An apparatus for deknitting a tape of yarn according to claim 3, wherein said rotatable sleeve is formed of plastic.

8. An apparatus for deknitting a tape of yarn according to claim 1, wherein said adjustable connector is biased away from contact with said stationary connector.

9. An apparatus for deknitting a tape of yarn according to claim 1, further comprising at least two stationary connectors, said at least two stationary connectors comprising a first stationary connector and a second stationary connector, said first stationary connector being generally parallel and in close proximity to a first end of said frame structure and in close proximity to said adjustable connector, said second stationary connector being generally parallel to said first stationary connector and located more proximate to said second end of said frame structure.

10. An apparatus for deknitting a tape of yarn according to claim 1, further comprising at least one tape guiding connector attached to said frame structure, said at least one tape guiding connector being generally parallel to said at least one stationary connector and positioned so as to guide said tape of yarns into contact with said stationary connector and said adjustable connector.

11. An apparatus for deknitting a tape of yarn according to claim 10, wherein at least one of said at least one tape guiding connector, at least one stationary connector and said adjustable connector is of a generally cylindrical shape and is at least partially surrounded by a rotatable sleeve.

12. An apparatus for deknitting a tape of yarn according to claim 10, wherein all of said at least one stationary connector and said adjustable connector is of a generally cylindrical shape and is at least partially surrounded by a rotatable sleeve.

13. An apparatus for deknitting a tape of yarn according to claim 1, further comprising a mounting member connected to said frame structure.

14. An apparatus for deknitting a tape of yarn according to claim 1, wherein said adjustment controller is adjustable in increments of 0.005 inches.

15. An apparatus for deknitting a tape of yarn according to claim 1, wherein said adjustment controller further comprises an adjustment coordinating assembly.

16. An apparatus for deknitting a tape of yarn according to claim 15, wherein said adjustment coordinating assembly is motorized.

17. An apparatus for deknitting a tape of yarn according to claim 16, wherein said motorized adjustment coordinating assembly is computer controlled.

18. An apparatus for deknitting a tape of yarn under substantially uniform and constant tension comprising:

a frame structure having at least two frame members, said frame members each having a first end and a second end and at least one adjustable connector, adjustably supported between said frame members, said adjustable connector having a generally cylindrical shape, being generally in parallel alignment with said stationary connector, and being at least partially surrounded by a rotatable sleeve.

19. An apparatus for deknitting a tape of yarn under substantially uniform and constant tension comprising:

a frame structure having at least two frame members, said frame members each having a first end and a second end;

at least one adjustable connector, adjustably supported between said frame members, said adjustable connector having a generally cylindrical shape and being at least partially surrounded by a rotatable sleeve; and an adjustment controller movably connected to said frame structure and in contact with said adjustable connector, wherein said adjustment controller when selectively moved serves to adjust the proximity of said adjustable connector to said stationary connector to define a deknitting restraining gap for receiving a tape of yarn between said stationary connector and said adjustable connector, wherein said tape of yarn when fed through said deknitting restraining gap is substantially uniformly deknitted under constant tension.

20. An apparatus for deknitting a tape of yarn according to claim 10, further comprising at least one tape guiding connector attached to said frame structure, said at least one tape guiding connector being generally parallel to said at least one stationary connector and positioned so as to guide said tape of yarns into contact with said stationary connector and said adjustable connector, said at least one tape guiding connector being of a generally cylindrical shape and being at least partially surrounded by a rotatable sleeve.

21. A method of deknitting a tape of yarn comprising the steps of:

(a) providing a tape of yarn to a deknitting device, said deknitting device comprising:

(i) a frame structure having at least two frame members, said frame members each having a first end and a second end, said frame members supporting at least one stationary connector between said frame members;

(ii) an adjustable connector, adjustably supported between said frame members, said adjustable connector generally being in parallel alignment with said stationary connector;

(iii) an adjustment controller movably connected to said frame structure and in contact with said adjustable connector, wherein said adjustment controller when selectively moved serves to adjust the proximity of said adjustable connector to said stationary connector to define a deknitting restraining gap for receiving a tape of yarn between said stationary connector and said adjustable connector, (b) adjusting said adjustable controller to define said deknitting gap between said stationary connector and said adjustable connector to an effective dimension for deknitting a tape of yarn;

(c) feeding said tape through said deknitting restraining gap at a substantially constant speed, wherein said tape of yarn when fed through said deknitting restraining gap is substantially uniformly deknitted under constant tension.

22. A method of deknitting a tape of yarn according to claim 21, wherein said effective dimension of said deknitting restraining gap is about 0.05 to 0.090 inches.

23. A method of deknitting a tape of yarn according to claim 21, wherein said effective dimension of said deknitting restraining gap is about 0.065 to 0.080 inches.

24. A method of deknitting a tape of yarn according to claim 21, wherein said tape of yarn is an elastic material.

25. A method of deknitting a tape of yarn according to claim 24, wherein said elastic material is selected from the group consisting of polyester elastic thread, polyether elastic thread, natural rubber thread, synthetic rubber thread, neoprene rubber thread, strip rubber thread, cut rubber covered yarns, natural fiber thread, synthetic fiber thread, rigid yarns, textured yarns, and textile yarns.

* * * * *